US011180277B2

(12) United States Patent
Tamura

(10) Patent No.: US 11,180,277 B2
(45) Date of Patent: Nov. 23, 2021

(54) THREE-DIMENSIONAL BODY, CONTAINER, AND METHOD FOR MANUFACTURING CONTAINER

(71) Applicant: TOKAN KOGYO CO., LTD., Tokyo (JP)

(72) Inventor: Kazuhisa Tamura, Tokyo (JP)

(73) Assignee: TOKAN KOGYO CO., LTD., Tokyo (JP)

( * ) Notice: Subject to any disclaimer, the term of this patent is extended or adjusted under 35 U.S.C. 154(b) by 0 days.

(21) Appl. No.: 16/615,079

(22) PCT Filed: Jul. 10, 2018

(86) PCT No.: PCT/JP2018/025987
§ 371 (c)(1),
(2) Date: Nov. 19, 2019

(87) PCT Pub. No.: WO2019/026565
PCT Pub. Date: Feb. 7, 2019

(65) Prior Publication Data

US 2020/0207505 A1 Jul. 2, 2020

(30) Foreign Application Priority Data

Aug. 3, 2017 (JP) ..... JP2017-151060

(51) Int. Cl.
*B65D 3/14* (2006.01)
*B31B 50/00* (2017.01)
*B31B 50/26* (2017.01)

(52) U.S. Cl.
CPC ..... *B65D 3/14* (2013.01); *B31B 50/0045* (2017.08); *B31B 50/26* (2017.08)

(58) Field of Classification Search
CPC ..... B65D 3/14; B65D 3/06; B65D 5/0209; B65D 5/12; B65D 5/40;
(Continued)

(56) References Cited

U.S. PATENT DOCUMENTS 1,234,633 A 7/1917 Craven
1,435,120 A 11/1922 Holman
(Continued)

FOREIGN PATENT DOCUMENTS

CN 202163760 U 3/2012
CN 105947343 A 9/2016
(Continued)

OTHER PUBLICATIONS

International Search Report and Written Opinion for PCT/JP2018/025987, dated Oct. 2, 2018.
(Continued)

*Primary Examiner* — Christopher R Demeree
(74) *Attorney, Agent, or Firm* — Maschoff Brennan; Brent A. Johnson; Yuefen Zhou

(57) ABSTRACT

A body portion (120A) that is a cylindrical body has one end portion, such as a lower end portion or the body portion (120A) or a first part (126) of a body portion (120), that is folded back inwardly. The body portion (120A) has at least one planar-shaped flat section, such as a second flat section (122) or a fourth flat section (124). A notch, such as a notch (K1) or a notch (K2), is provided at one end, such as a lower end, of the flat section. The one end portion includes a portion provided with the notch, such as by providing the notch (K1) or (K2) at a lower end of the lower end portion of the body portion (120A) or at a distal end of the first part (126A) of the body portion (120).

5 Claims, 6 Drawing Sheets

(58) Field of Classification Search
CPC ..... B65D 2543/00101; B65D 2543/00638; B65D 3/04; B65D 5/06; B65D 85/10484; B31B 50/0045; B31B 50/26
USPC ..... 229/107, 4.5, 5.5, 104, 400, 405; 220/620
See application file for complete search history.

(56) References Cited

U.S. PATENT DOCUMENTS

| | | | | | |
|---|---|---|---|---|---|
| 1,866,496 | A | | 7/1932 | Witte | |
| 1,969,030 | A | | 8/1934 | Page | |
| 2,733,852 | A | * | 2/1956 | Williamson | B65D 5/14 229/108.1 |
| 2,884,175 | A | * | 4/1959 | Wilson | B65D 3/10 229/5.5 |
| 3,923,233 | A | * | 12/1975 | Smith | B65D 3/14 229/5.5 |
| 4,792,086 | A | * | 12/1988 | Chen | A45F 3/20 229/117 |
| 4,854,474 | A | * | 8/1989 | Murray | A45F 3/20 220/1.5 |
| 6,032,823 | A | * | 3/2000 | Bacon | B65D 3/04 220/620 |
| 2012/0043374 | A1 | | 2/2012 | Lemon | |

FOREIGN PATENT DOCUMENTS

| | | | |
|---|---|---|---|
| DE | 3110697 | A1 | 10/1982 |
| GB | 1073467 | | 6/1967 |
| JP | S41979016957 | Y2 | 7/1979 |
| JP | S631988011310 | U | 1/1988 |
| JP | H021990011281 | Y2 | 3/1990 |
| JP | H061994042639 | U | 6/1994 |
| JP | 2001301737 | A | 10/2001 |
| JP | 2003072734 | A | 3/2003 |
| JP | 2003276721 | A | 10/2003 |

OTHER PUBLICATIONS

The Office Action issued by the China National Intellectual Property Administration (CNIPA) dated Dec. 2, 2020 for the Chinese Patent Application No. 201880047264.9.
Extended European Search Report for European Patent Application No. 18842381.8, dated Mar. 11, 2021.

* cited by examiner

THREE-DIMENSIONAL BODY, CONTAINER, AND METHOD FOR MANUFACTURING CONTAINER

CROSS REFERENCE TO RELATED APPLICATIONS

This application is a national phase of International Patent Application No. PCT/JP2018/025987, filed Jul. 10, 2018, which claims priority to Japanese Patent Application No. 2017-151060, filed Aug. 3, 2017, all of which are incorporated by reference herein in their entirety.

TECHNICAL FIELD

The present disclosure relates to a cylindrical body used for a paper container or the like, a container such as a paper container, and a method for manufacturing the container.

BACKGROUND ART

Containers such as paper containers are manufactured heretofore. For example, Patent Literature 1 describes a container, that is a paper cup that uses as a body portion a cylindrical body for which one end portion is folded back inwardly, and in which the cylindrical body is a body portion member provided with an annular leg section (18) formed by inwardly folding back a lower end portion.

CITATION LIST

Patent Literature

Patent Literature 1: Unexamined Japanese Patent Application Kokai Publication No. 2003-276721

SUMMARY OF INVENTION

Technical Problem

Although the container described in Patent Literature 1 has a cross section and a bottom that are circular, containers are also considered that have, such as in FIG. 1, a substantially trapezoid-shaped cross section and bottom, or that have at least one planar-shaped flat section. In the manufacture of such a container, although one end portion of the cylindrical body forming the body portion is to be folded back inwardly in the same manner as in the container of Patent Literature 1, buckling occurs in the folded-back portion of the flat section due to such folding back.

An object of the present disclosure is to provide a cylindrical body, a container, and a method for manufacturing the container for which buckling due to folding back tends not to occur.

Solution to Problem

In order to attain the aforementioned objective, a cylindrical body according to a first aspect of the present disclosure is a cylindrical body, such as a body portion 120A, for which one end portion, such as a lower end portion of the body portion 120A or a first part 126A of a body portion 120, is folded back. The cylindrical body has at least one planar-shaped flat section, such as a second flat section 122 or a fourth flat section 124. One end, such as a lower end, of the flat section is provided with a notch, such as a notch K1 or a notch K2. The one end portion includes a portion provided with the notch, such as by providing the notch K1 or K2 at a location such as a lower end of the body portion 120A or a distal end of a first part 126A of the body portion 120.

A notching depth of the notch may gradually increase toward a center of the notch from both end portions of the notch (for example, see the shapes of the notch K1 or the notch K2 in FIG. 3).

The notch may be triangularly-shaped.

The cylindrical body has a cross section that is substantially trapezoid-shaped and has four curved corners; for example, a notch may be provided in at least one flat section of four flat sections forming four sides of the trapezoid shape; and for example, the four sides may have a configuration such as two short sides and two long sides.

In order to achieve the aforementioned objective, the container according to a second aspect of the present disclosure may include: a body portion, such as the body portion 120, that has a cylindrical body having one end portion folded back inwardly, and a bottom section, such as the bottom section 110 retained by the first part 126A by the projection portion 112 being sandwiched by the bending section 126 included in the first part 126A, retained by the folded-back one end portion.

According to the present disclosure, a method for manufacturing a container according to a third aspect of the present disclosure includes: a first step of forming a blank, such as a step that forms a blank shaped as illustrated in FIG. 3 by punching out paper raw material; a second step of forming the cylindrical body from the blank, such as a step that forms the body portion 120A by wrapping the blank against a mandrel 200; and a third step of folding back inwardly the one end portion of the cylindrical body, such as a step of using a curling tool 300 to fold back inwardly the lower end portion of the body portion 120A as illustrated in FIG. 5. The blank formed in the first step includes a notch, such as the notch K1 or the notch K2.

Advantageous Effects of Invention

According to the present disclosure, the cylindrical body, the container, and the method for manufacturing the container can be provided such that buckling due to folding back tends not to occur.

DESCRIPTION OF EMBODIMENTS

A cylindrical body, a container, and a method for manufacturing the container in accordance with embodiments of the present disclosure are described below with reference to drawings.

Structure of Container 100

Figure 1:
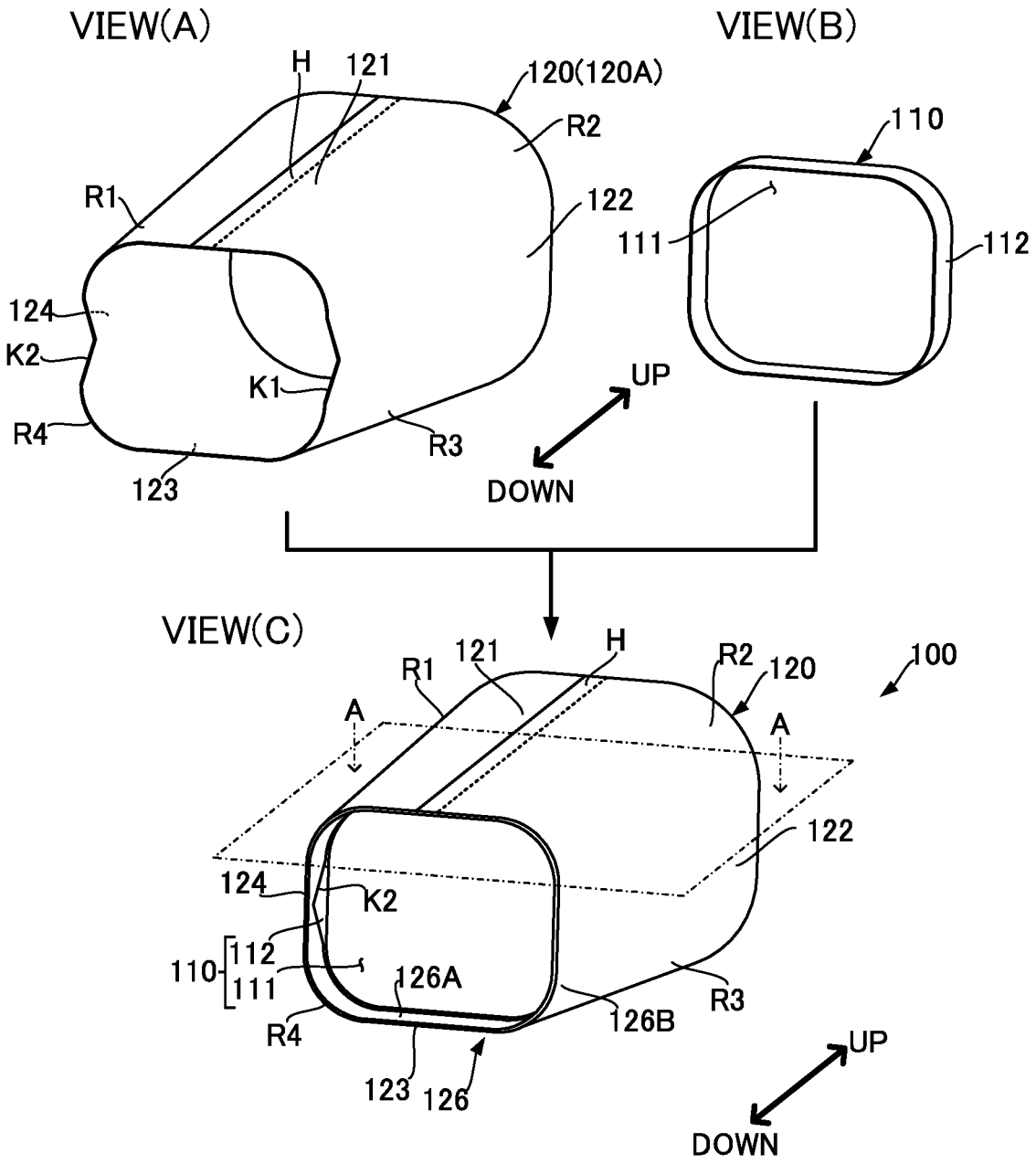
FIG. 1 is an exploded perspective view, that is, a perspective view of a body portion and a bottom section, of a container according to an embodiment of the present disclosure and a perspective view of the container, in which view (A) is a perspective view of the body portion, that is, a cylindrical body, prior to forming of a bending section, view (B) is a perspective view of the bottom section, and view (C) is a perspective view of the container.
Figure 2:
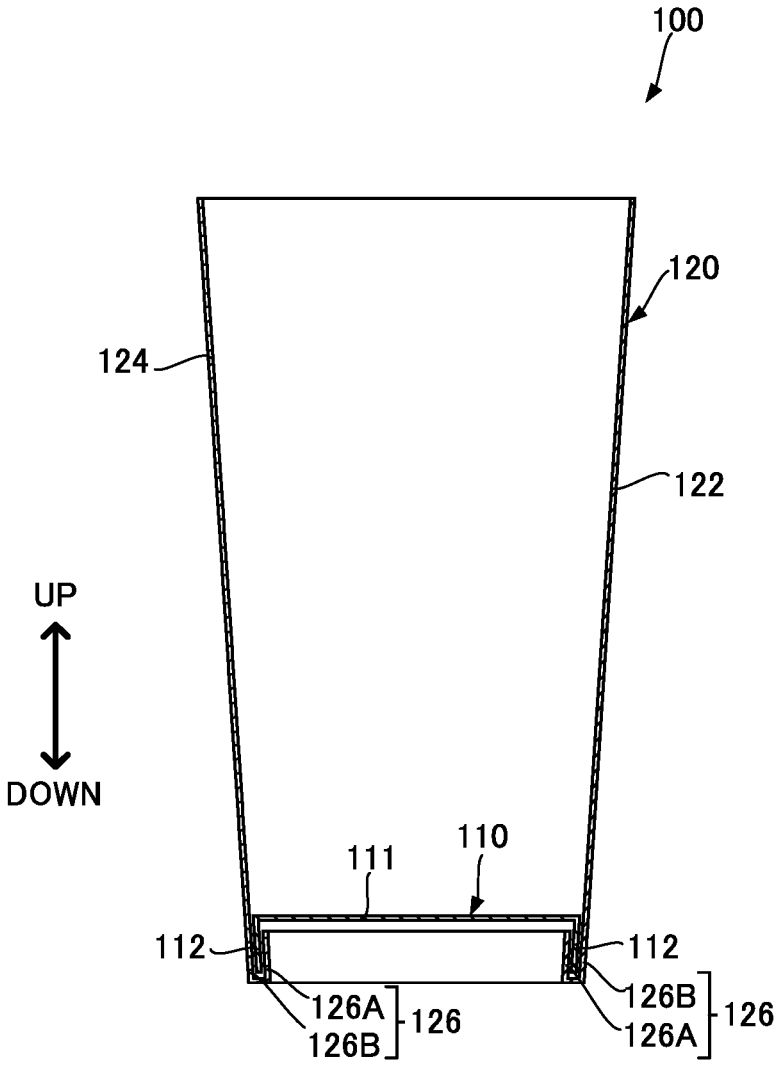
FIG. 2 is a cross-sectional view taken along line A-A of FIG. 1 for the container according to the embodiment of the present disclosure.
Figure 3:
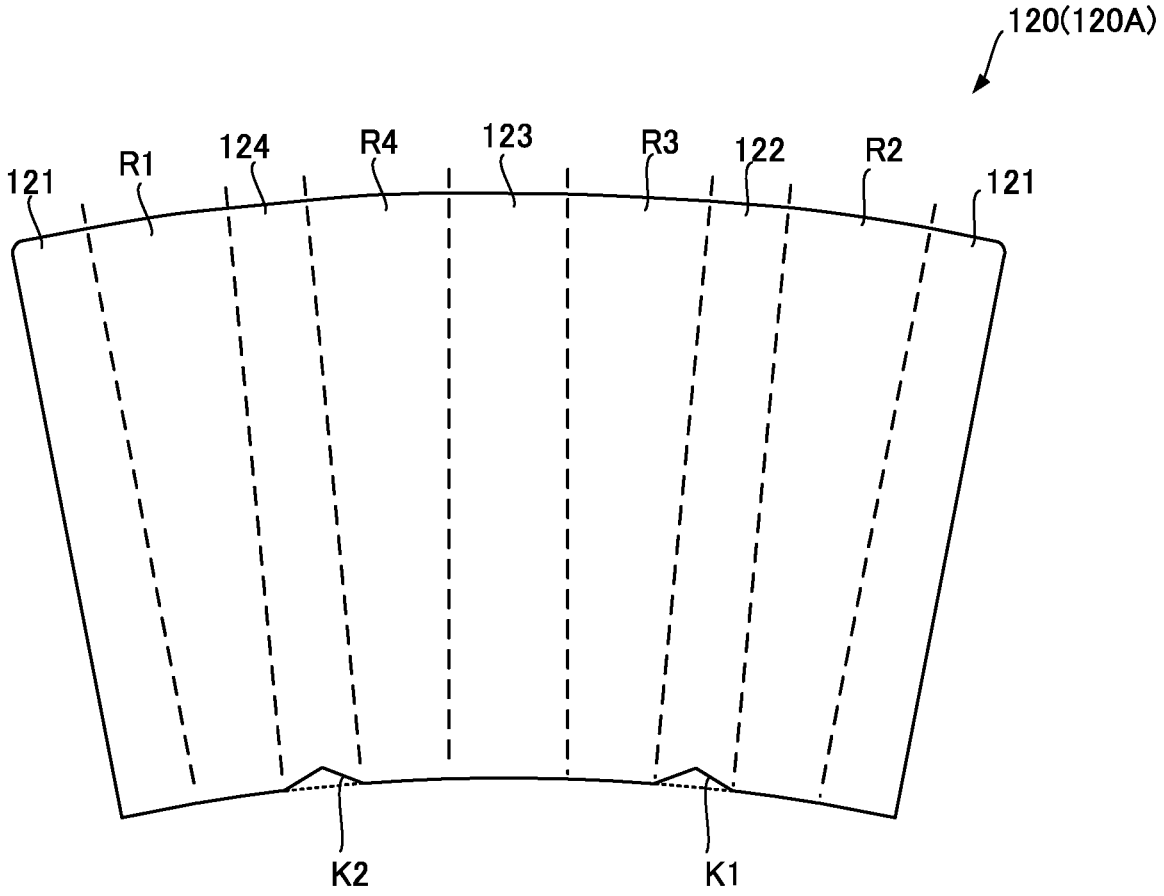
FIG. 3 is an exploded view of the body portion of the container according to the embodiment of the present disclosure, that is, is a plan view of a blank that is the material of the body portion.

Firstly, structure of a container 100 according to an embodiment of the present disclosure is described with reference to FIGS. 1 to 3. The container 100 has a substantially trapezoid-shaped bottom section 110 and a tubular-shaped body portion 120 that has a substantially trapezoid-shaped cross section. Here, the expression "substantially trapezoid-shaped" refers to a trapezoid shape with curves formed at the four corners. The bottom section 110 and the body portion 120 are formed from paper provided with a resin layer on an interior surface side of the container 100.

The bottom section 110 has a bottom plate 111 that is substantially trapezoid-shaped and forms a bottom of the container 100 and a projection portion 112 that projects downward from an edge of the bottom plate 111. The projection portion 112 is tube-shaped with a substantially trapezoid-shaped cross section.

The body portion 120 is provided with a bending section 126 at a lower portion thereof, and has a shape that, in the upward direction, that is, in the direction opposite to the direction of the bottom, gradually spreads outward. The body portion 120 is formed by a folding-fan-shaped sheet (see FIG. 3) that is a so-called blank. The body portion 120 is formed by winding of the blank into a tubular shape, and then forming the bending section 126 in the cylindrical body illustrated in view (A) of FIG. 1. The blank is obtained, for example, by punching out into the shape illustrated in FIG. 3 paper raw material, that is, paper provided with a resin layer on an interior surface side of the container 100. The body portion 120 has an adhesion section H. The adhesion section H is a part that is formed by overlapping both end portions of the blank wound into the tubular shape and then thermal-fusion bonding the end portions by use of the resin layer. Further, the cylindrical body prior to forming of the bending section 126, as in view (A) of FIG. 1, is also referred to as the body portion 120A.

The body portion 120 or the body portion 120A has a first flat section 121 and a third flat section 123 that are planar-shaped, that is, are flat sheets, and form the substantially trapezoid-shaped long sides as viewed in the cross section, a second flat section 122 and a fourth flat section 124 that are planar-shaped and form the substantially trapezoid-shaped short sides as viewed in the cross section, and corner parts R1 to R4 are bent to form the four corners of the substantially trapezoid shape as viewed in the cross section.

The bending section 126 is formed by folding back inwardly the lower end portion of the body portion 120A, that is the lower end portions of the corner parts R1 to R4 and the first to fourth flat sections 121 to 124 of the body portion 120A. The bending section 126 has a first part 126A that is the inwardly folded-over lower end portion and a second part 126B that faces the first part 126A. The projection portion 112 of the bottom section 110 is sandwiched between the first part 126A and the second part 126B. Due to such configuration, the bottom section 110 is fixed to the interior of the body portion 120 to form the container 100. Although the projection portion 112 is illustrated as separated from the first part 126A and from the second part 126B in FIG. 2 to facilitate understanding, these parts are actually in contact with each other; and parts that are actually in contact with each other may be illustrated as separated from each other also in other drawings.

Within the body portion 120A, the triangularly-shaped notch K1 is provided at the lower end of the second flat section 122, and the triangularly-shaped notch K2 is provided at the lower end of the fourth flat section 124. Further, the lower end of the second flat section 122 and the lower end of the fourth flat section 124 each include a distal end, that is, an upper end, of the first part 126A that is a folded-back part. That is to say, the first part 126A is provided with the notches K1 and K2 and is folded back. The notches K1 and K2 lower a rate of occurrence of buckling when the bending section 126 is formed. These notches K1 and K2 are described below.

Manufacturing Method of Container 100

Figure 4A:
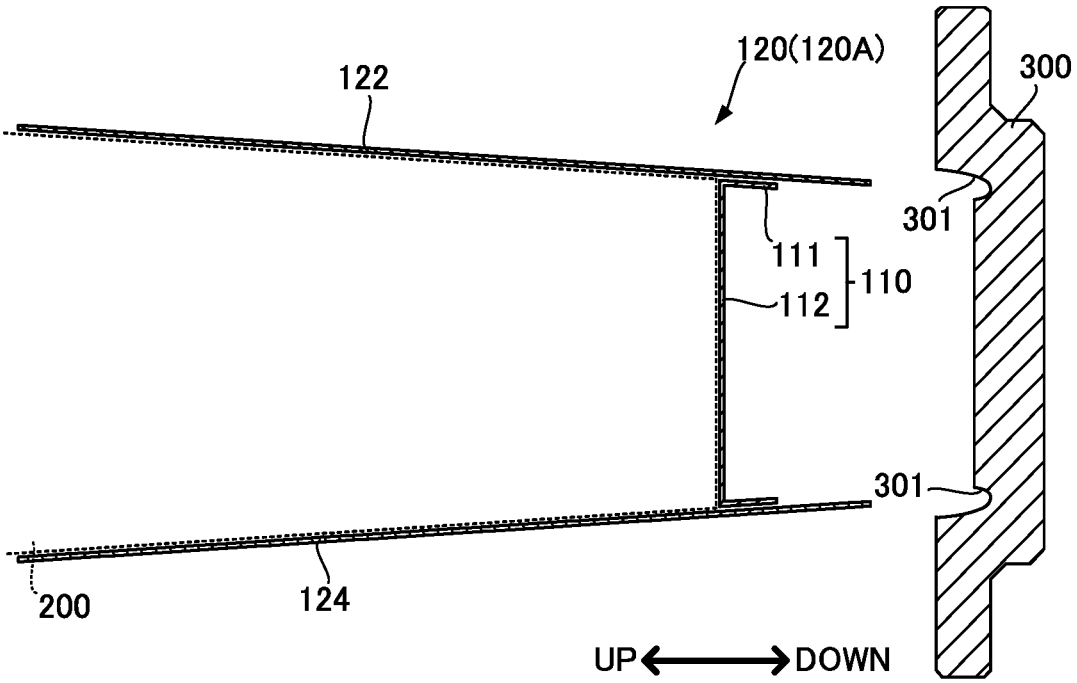
FIG. 4A illustrates formation of the body portion by wrapping a blank around a mandrel, as an illustration for description of a method for manufacturing of the container according to the embodiment of the present disclosure, that is, this illustrates a cross-sectional view of components such as the bottom section of the container, the body portion of the container, and a curling tool.
Figure 4B:
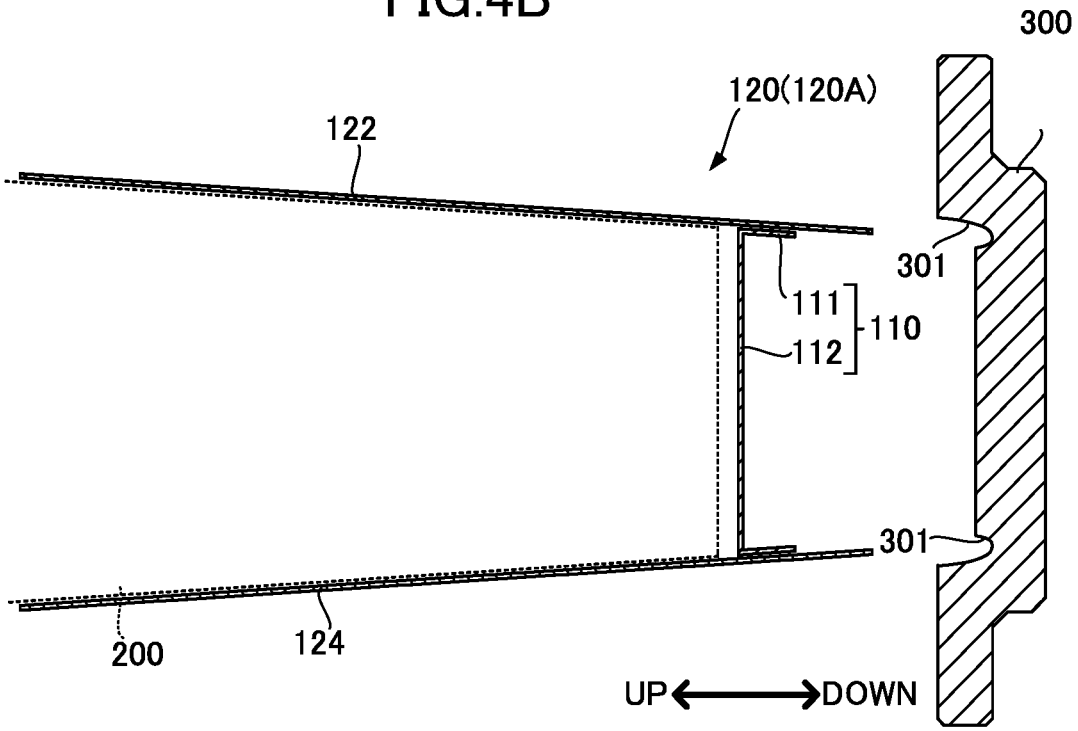
FIG. 4B illustrates fitting of the bottom section against an inner surface of the body portion, as an illustration for description of the method for manufacturing of the container according to the embodiment of the present disclosure, that is, this illustrates a cross-sectional view of components such as the bottom section of the container, the body portion of the container, and a curling tool.
Figure 5:
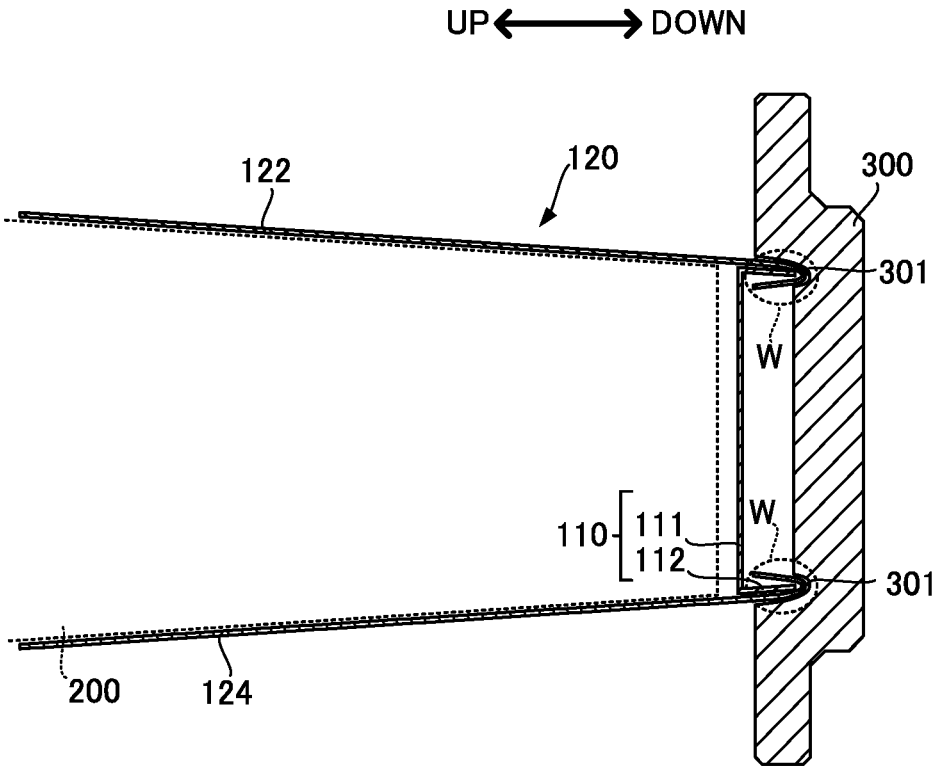
FIG. 5 is a drawing for description of the method for manufacturing the container according to the embodiment of the present disclosure, that is, a cross-sectional view of components such as the bottom section of the container, the body portion of the container, and the curling tool, and this drawing illustrates folding back inwardly of the lower end portion of the body portion by the curling tool in one operation.
Figure 6:
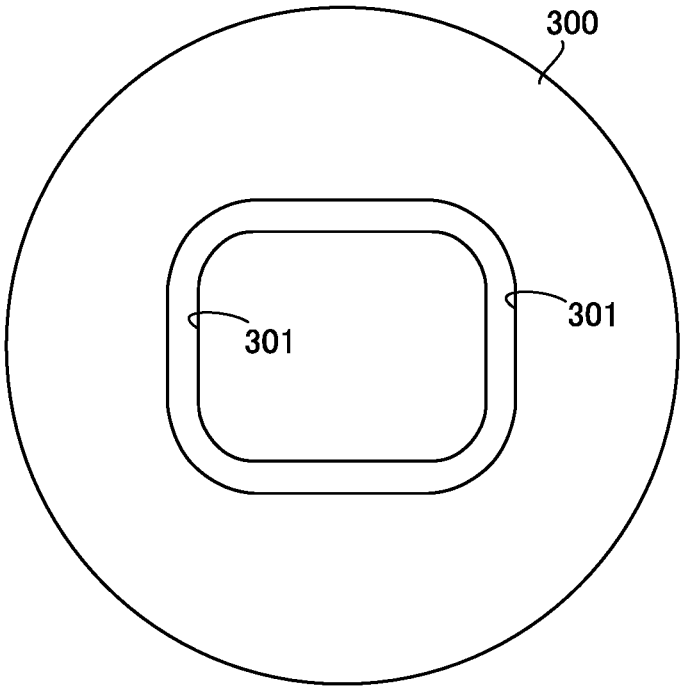
FIG. 6 is a plan view of the curling tool as viewed from above.

A manufacturing method of the container 100 is described next with reference to FIGS. 4 to 6. Firstly, the adhesion section H, as illustrated in FIG. 1, is formed by wrapping the blank, as illustrated in FIG. 3, around the mandrel 200 by a freely-selected method, overlapping the end portions of the blank, and thermal fusion bonding the overlapped end portions. The outer peripheral surface of the mandrel 200 is trapezoidal pillar-shaped with a substantially trapezoid-shaped cross section. The blank is wound around the mandrel 200, and the body portion 120A, as illustrated in view (A) of FIG. 1, is formed by forming the adhesion section H. FIG. 4A illustrates appearance at this time. Although the mandrel 200 is illustrated as separated from the bottom section 110 and the body portion 120A in FIG. 4A, these components are actually in contact with each other; and FIG. 4B and FIG. 5 are similarly illustrated in this manner. The distal end portion of the mandrel 200 has a non-illustrated air hole. The bottom section 110 manufactured in a separate step is attached by air suction to the distal end portion via the air hole. The bottom section 110 is positioned in the interior of the body portion 120A (see FIG. 4A).

In the state illustrated in FIG. 4A, air is blown from the air hole of the distal end portion of the mandrel 200 so that the bottom section 110 inflates. The inflated bottom section 110 fits into the inner surface of the body portion 120A. The state during this operation is illustrated in FIG. 4B. Although the bottom section 110 and the body portion 120A are shown separated from each other in FIG. 4B, these components are actually in contact with each other, and FIG. 5 is illustrated similarly.

Then in the state illustrated in FIG. 4B, the curling tool 300 used for forming the bending section 126 is pressed against the body portion 120A, and the lower end portion of the body portion 120A, that is, the right end portion as illustrated in FIGS. 4 and 5, is folded back in one operation. The state at this time is illustrated in FIG. 5. The curling tool 300 is provided with a concavity 301 having a substantially trapezoidal ring-shape as seen in plan view (see FIG. 6). The concavity 301 has curved inner surfaces, and when the curling tool 300 presses against the body portion 120A, the lower portion of the body portion 120A bends inwardly along the inner surfaces of the concavity 301. This portion bent by being folded back is referred to as a curved section W. Although the curved section W of the body portion 120A and the inner surface of the concavity 310 of the curling tool are illustrated as separated from each other in FIG. 5, these components are actually in contact with each other. The projection portion 112 of the bottom section 110 is inserted into the inner portion of the curved section W. In this state, a prescribed tool is used to collapse the curved section W, by an operation such as thermal compression bonding, to form the bending section 126. Due to formation of the bending section 126, the projection portion 112 is sandwiched and supported by the bending section 126, that is, by the first part 126A and the second part 126B, and the container 100 is completed.

Figure 7:
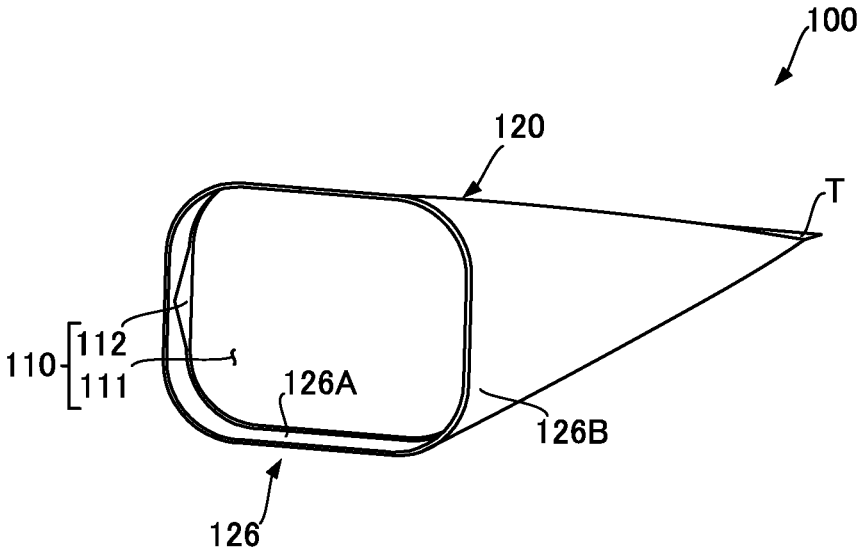
FIG. 7 is a perspective view illustrating an example of use of the container.

Prescribed content, such as confectionary, may be inserted into the container 100, and as illustrated in FIG. 7, for example, an opening of the container 100 may be closed linearly to form a closed section T, the opening of the container 100 may be provided with a curl, and the container 100 may be formed as a paper cup that has a substantially trapezoid-shaped bottom.

Notches K1 and K2

During forming of the bending section 126 in the body portion 120A in the aforementioned manner, the curling tool 300 is used to inwardly fold back the lower end portion of the body portion 120A, that is, the portion corresponding to the first part 126A. In this folding-back step, the lower end portion of the folded-back body portion 120 is compressed so as to shorten in circumference.

Although the inventors of the present disclosure initially performed the folding back without providing the notches K1 and K2 (see short-dashed lines in FIG. 3), the inventors of the present disclosure discovered that buckling, such as the formation of corrugations, occurred in portions of the second flat section 122 and the fourth flat section 124 within the curved section W or the first part 126A of the bending section 126. When the inventors of the present disclosure examined the cause of such buckling, due to the relationship between the shape of the concavity 301 of the curling tool 300 used in the manufacture of the container 100 and the shape of the body portion 120A, degree of compression during the folding back was found to be high at the lower end portions of the second flat section 122 and the fourth flat section 124 formed in the short sides of the substantially trapezoid-shaped cross section of the body portion 120A.

That is to say, the buckling is predicted to be generated due a high degree of compression.

Thus in this embodiment, the inventors of the present disclosure attempted, by providing the triangularly-shaped notches K1 and K2, to avoid the generation of compressive force during the inward folding back. As a result, the frequency of the occurrence of the buckling decreased. That is, buckling during folding back seldom occurred.

Further, buckling is understood to seldom occur in the curved portions such as the corner parts R1 to R4, that is, in portions formed by curved surfaces. This is thought to be due the curved portions, due to curvature, being resistant to the compressive force. However, the first to fourth flat sections 121 to 124 forming each side of the substantially trapezoid-shaped cross section are planar-shaped, and thus are weak with respect to the compressive force, and are understood to easily undergo buckling in accordance with the degree of compression due to folding back. Thus in accordance to the degree of pressure due to the folding back, notches such as the aforementioned notches K1 and K2 may be provided in a portion or the entire lower end, that is, in the distal end of the first part 126A, of the first to fourth flat sections 121 to 124 of the body portion 120A. Further, at least one such notch may be provided in the lower end, that is, the distal end of the first part 126A, of the corner parts R1 to R4 of the body portion 120A.

The occurrence of buckling can be effectively prevented by forming the shape of the notch to be resistant to buckling during the folding back, that is, by shaping the notch such that the notching depth increases gradually from both end portions toward the center along the width direction of the notch. As illustrated such as in FIG. 3, triangular shapes such as those of the notches K1 and K2 are examples of such a shape. Other examples of such shapes include semi-circular shapes, semi-elliptical shapes, or the like. Further, the shape of the notch may be a shape other than the above-listed shapes. The bending section 126 may have a good appearance due to forming the notch with a shape such as the triangular shape. The term "width direction" is taken to be the direction of extension, that is, the direction of the periphery when the body portion 120A is formed by wrapping the blank, of the lower end of a flat section, that is, one of the first to fourth flat sections 121 to 124, provided with the notch. The notch may be trapezoid-shaped, slit-shaped, or the like. Within the lower end of the flat section, the notch may be provided on the entire width direction or in a portion that includes at least the center in the width direction. Multiple notches may be provided in the lower end of a single flat section.

Other Embodiments

The present disclosure is not limited to the aforementioned embodiments, and various types of modifications and applications of the aforementioned embodiments are possible. Modified examples are described below.

The present disclosure is applicable to a general cylindrical body that has one end portion folded back internally. In particular, the present disclosure is applicable to a cylindrical body that has one end portion folded back inwardly in a single operation by a tool such as the curling tool 300. The cylindrical body may be used for an application other than the body portion of the container as described above. The one end portion that is folded back inwardly may be a portion that is simply folded back without retention and fixing of the bottom section 110 as in the aforementioned embodiments. For example, the cylindrical body after folding back of the one end portion may be used as a body portion of the outside part of an item such as a paper cup in which the body portion is doubled so as to inhibit heat conduction. The one end portion may be the upper end portion. Rather than the cylindrical body being formed from paper as described above, the cylindrical body may be formed from a resin sheet, that is, a blank made of resin. Rather than being constructed from paper, the container for which the cylindrical body is used may be constructed from resin.

The cylindrical body including components such as the body portion 120A may have any shape that has at least one planar-shaped flat section. For example, the cross section may be substantially triangularly-shaped with each corner curved, substantially pentagon-shaped with each corner curved, semi-circularly shaped, or the like. The notch may be provided at one end that is a freely-selected portion that is easily subjected to buckling of at least one flat section.

Additional Embodiments and Modifications

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

This application claims the benefit of Japanese Patent Application No. 2017-151060, filed on Aug. 3, 2017, the entire disclosure of which is incorporated by reference herein.

REFERENCE SIGNS LIST

100 Container
110 Bottom section
111 Bottom plate
112 Projection portion
120, 120A Body portion
121 First flat section
122 Second flat section
123 Third flat section
124 Fourth flat section
126 Bending section
126A First part
126B Second part
R1 to R4 corner part
K1, K2 Notch

The invention claimed is:

1. A three-dimensional body having one end portion that is folded back inwardly, comprising:

four planar-shaped flat sections; and two notches arranged only at two ends of two flat sections of the four flat sections, wherein the three-dimensional body has a horizontal cross section, wherein the cross section forms a rectangular-shape; having four curved corners; and having two short sides and two long sides, the four flat sections form the two short sides and the two long sides of the rectangular-shape, the two flat sections having the two notches form the two short sides of the rectangular-shape of the horizontal cross section, the two notches are arranged in the bottom end portion of the three-dimensional body, and wherein the two notches are for preventing occurrence of buckling when folding back the one end portion inwardly.

2. The three-dimensional body according to claim 1, wherein a notching depth of each notch of the two notches increases gradually toward a center of the notch from both end portions of the notch.

3. The three-dimensional body according to claim 1, wherein the two notches are triangularly-shaped.

4. A container comprising:

a body portion having the three-dimensional body according to claim 1, wherein the three-dimensional body has one end portion that is folded back inwardly; and a bottom section retained by the one end portion that is folded back.

5. A method for manufacturing a container, comprising:

a first step of forming a blank;

a second step of forming the three-dimensional body according to claim 1; and a third step of folding back inwardly the one end portion of the three-dimensional body, wherein the blank formed in the first step includes the two notches.

* * * * *